US012546560B2

(12) United States Patent
Liang et al.

(10) Patent No.: US 12,546,560 B2
(45) Date of Patent: Feb. 10, 2026

(54) AIR GUN

(71) Applicant: S-BEAM PRECISION PRODUCTS LIMITED, Zhongshan (CN)

(72) Inventors: Ming Liang, Zhongshan (CN); Xiaoliang Luo, Zhongshan (CN)

(73) Assignee: S-BEAM PRECISION PRODUCTS LIMITED, Zhongshan (CN)

( * ) Notice: Subject to any disclaimer, the term of this patent is extended or adjusted under 35 U.S.C. 154(b) by 109 days.

(21) Appl. No.: 18/539,329

(22) Filed: Dec. 14, 2023

(65) Prior Publication Data

US 2025/0116482 A1 Apr. 10, 2025

(30) Foreign Application Priority Data

Oct. 9, 2023 (CN) ..... 202322703777.1

(51) Int. Cl.
*F41B 11/723* (2013.01)
*F41B 11/62* (2013.01)
*F41B 11/73* (2013.01)

(52) U.S. Cl.
CPC ..... *F41B 11/723* (2013.01); *F41B 11/62* (2013.01); *F41B 11/73* (2013.01)

(58) Field of Classification Search
CPC ..... F41B 11/723; F41B 11/62; F41B 11/73; F41B 11/72; F41B 11/721
See application file for complete search history.

(56) References Cited

U.S. PATENT DOCUMENTS

| | | | | |
|---|---|---|---|---|
| 12,098,901 | B2 * | 9/2024 | Axelsson | F41B 11/73 |
| 2019/0107359 | A1 * | 4/2019 | Rotrekl | F41B 11/60 |
| 2024/0263912 | A1 * | 8/2024 | Axelsson | F41B 11/723 |

FOREIGN PATENT DOCUMENTS

| | | | | |
|---|---|---|---|---|
| WO | WO-2008086455 | A2 * | 7/2008 | F41A 11/02 |

* cited by examiner

*Primary Examiner* — Jonathan C Weber
(74) *Attorney, Agent, or Firm* — MATTHIAS SCHOLL P.C.; Matthias Scholl

(57) ABSTRACT

An air gun including: a cylinder, a cartridge, an air valve, a stop piece. The air valve includes an assembly channel, a communication port, and an air passage connected to the assembly channel through the communication port. The cartridge is disposed in the assembly channel and includes an ejection channel communicating with the air passage through the communication port. The stop piece is disposed on the air valve to push the cartridge towards the communication port, thereby locking the cartridge onto the air valve, and tightly fitting the cartridge and the air valve at least at an outer circumference of the communication port.

16 Claims, 8 Drawing Sheets

AIR GUN

CROSS-REFERENCE TO RELATED APPLICATIONS

Pursuant to 35 U.S.C. § 119 and the Paris Convention Treaty, this application claims foreign priority to Chinese Patent Application No. 202322703777.1 filed Oct. 9, 2023, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to an air gun.

An air gun includes a cylinder, a cartridge, an air valve. The air valve is used to connect or separate the cartridge and the cylinder. To facilitate assembly, the air valve of an existing air gun is connected to the cartridge through interference fit. In this way, the inner diameter of the hole disposed on the air valve must be uniquely corresponding to the outer diameter of the cartridge, i.e., the air valve can only be configured with a cartridge of unique size. Thus, the parts of the air gun have a low adaptability and when a wide range of cartridges with different sizes are produced, the air valves with corresponding sizes must be produced.

SUMMARY

The disclosure provides an air gun comprising an air valve and a cartridge connected to the air valve through at least one stop piece rather than interference fit.

The air gun of the disclosure comprises: a cylinder, a cartridge, an air valve, a stop piece; the air valve comprises an assembly channel, a communication port, and an air passage connected to the assembly channel through the communication port; the cartridge is disposed in the assembly channel and comprises an ejection channel communicating with the air passage through the communication port; the stop piece is disposed on the air valve to push the cartridge towards the communication port, thereby locking the cartridge onto the air valve, and tightly fitting the cartridge and the air valve at least at an outer circumference of the communication port.

In a class of this embodiment, the cartridge is provided with two first seal rings; the two first seal rings are disposed on opposite sides of the communication port, and against an outer wall of the cartridge and an inner wall of the assembly channel, respectively.

In a class of this embodiment, the outer wall of the cartridge comprises two seal grooves for receiving the two first seal rings, respectively; and the two first seal rings are embedded in corresponding seal grooves through interference fit.

In a class of this embodiment, an outer wall of the cartridge comprises a locating groove, and the stop piece extends into the locating groove.

In a class of this embodiment, a depth of the locating groove accounts for a quarter or one third of a wall thickness of the cartridge; and/or, one end of the stop piece against the cartridge is tapered, and a shape of the locating groove is corresponding to the one end of the stop piece against the cartridge.

In a class of this embodiment, the air valve comprises a connection channel for the stop piece to extend into the assembly channel, and the stop piece comprises a threaded part in threaded connected to the connection channel and a butting part connected to the threaded part to push against the cartridge.

In a class of this embodiment, the air valve comprises a connecting column extending radially outward from an outer wall of the air valve, and the connection channel is formed in the connecting column.

In a class of this embodiment, the connection channel communicates with outside, and an axial length of the connection channel is not less than an axial length of the stop piece.

In a class of this embodiment, the cartridge comprises a first pin capable of moving along the ejection channel to open and close the communication port; a second seal ring is disposed on the ejection channel, and butts against an outer wall of the first pin and an inner wall of the ejection channel; and/or, the cylinder comprises an inlet channel; the inlet channel communicates with the air passage through an intake port, and the air valve comprises a second pin capable of moving along the air passage to open and close the intake port.

In a class of this embodiment, the air valve is an integrally-formed structure and comprises a first connector connected to the cylinder and a second connector connected to the cartridge; the first connector is partially disposed in the inlet channel and the air passage is disposed in the first connector; the second connector is disposed on the first connector and the assembly channel is disposed in the second connector; and the cartridge is disposed through the assembly channel of the second connector.

The following advantages are associated with the air gun of the disclosure.

The cartridge of the disclosure is disposed in the assembly channel of the air valve and the cartridge is locked on the air valve by the stop piece. The cartridge and the air valve are tightly adhered to each other at least at the periphery of the communication port. The cartridge and the air valve are connected to each other through the stop piece butting against the cartridge to realize the connection between the cartridge and the air valve, so that the assembly channel can be adapted to the different sizes of the cartridge (the precondition is that the outer diameter of the cartridge is smaller than the inner diameter of the cartridge). In addition, the stop piece locks the cartridge on the air valve so that the cartridge tightly fits with the air valve at least in the periphery of the communication port. Thus, the air passage tightly communicates with the ejection channel in the vicinity of the communication port, thus preventing the air leakage and improving the shooting effect.

DETAILED DESCRIPTION

To further illustrate the disclosure, embodiments detailing an air gun are described below. It should be noted that the following embodiments are intended to describe and not to limit the disclosure.

Figure 1:
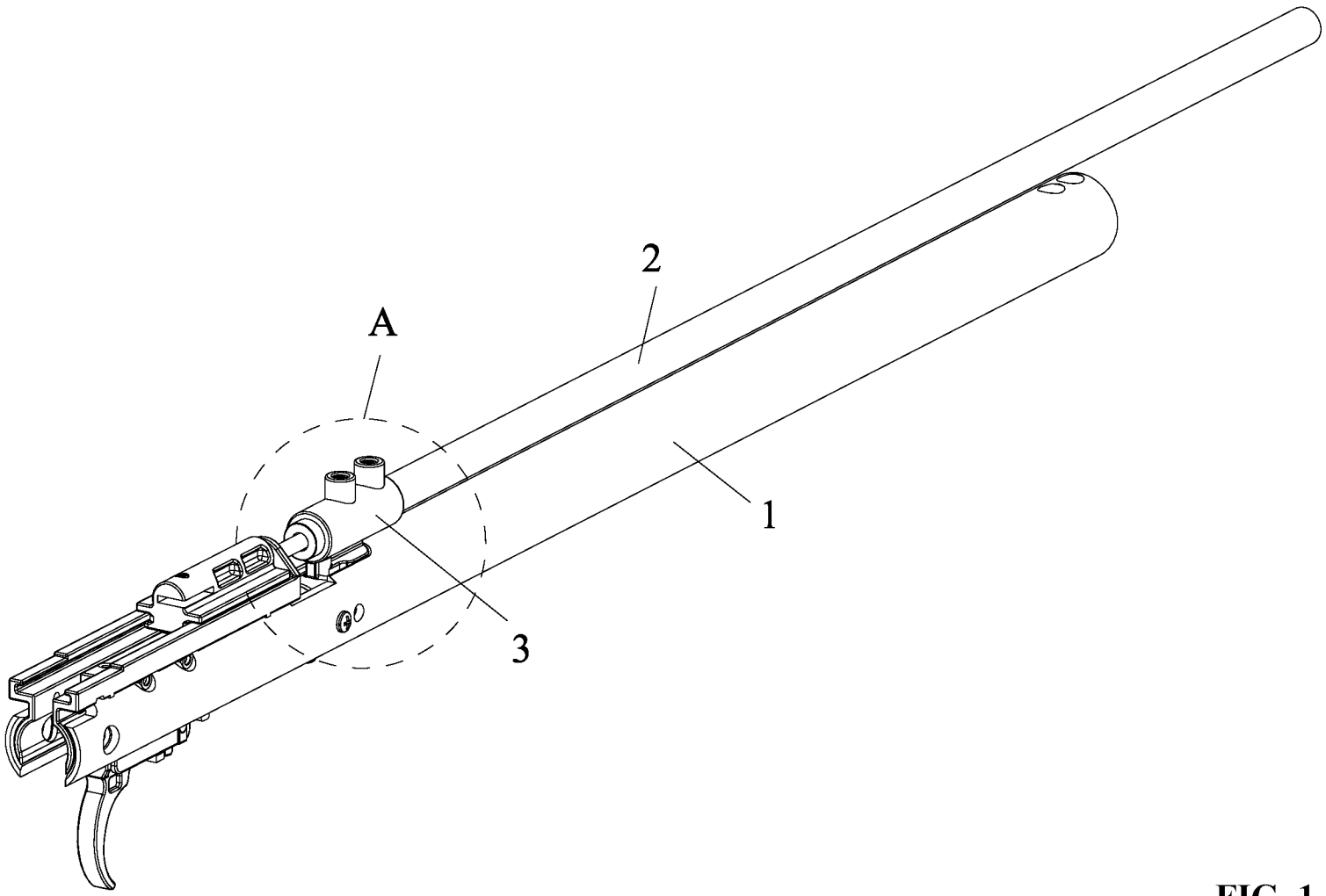
FIG. 1 is a stereograph of an air gun of the disclosure.
Figure 2:
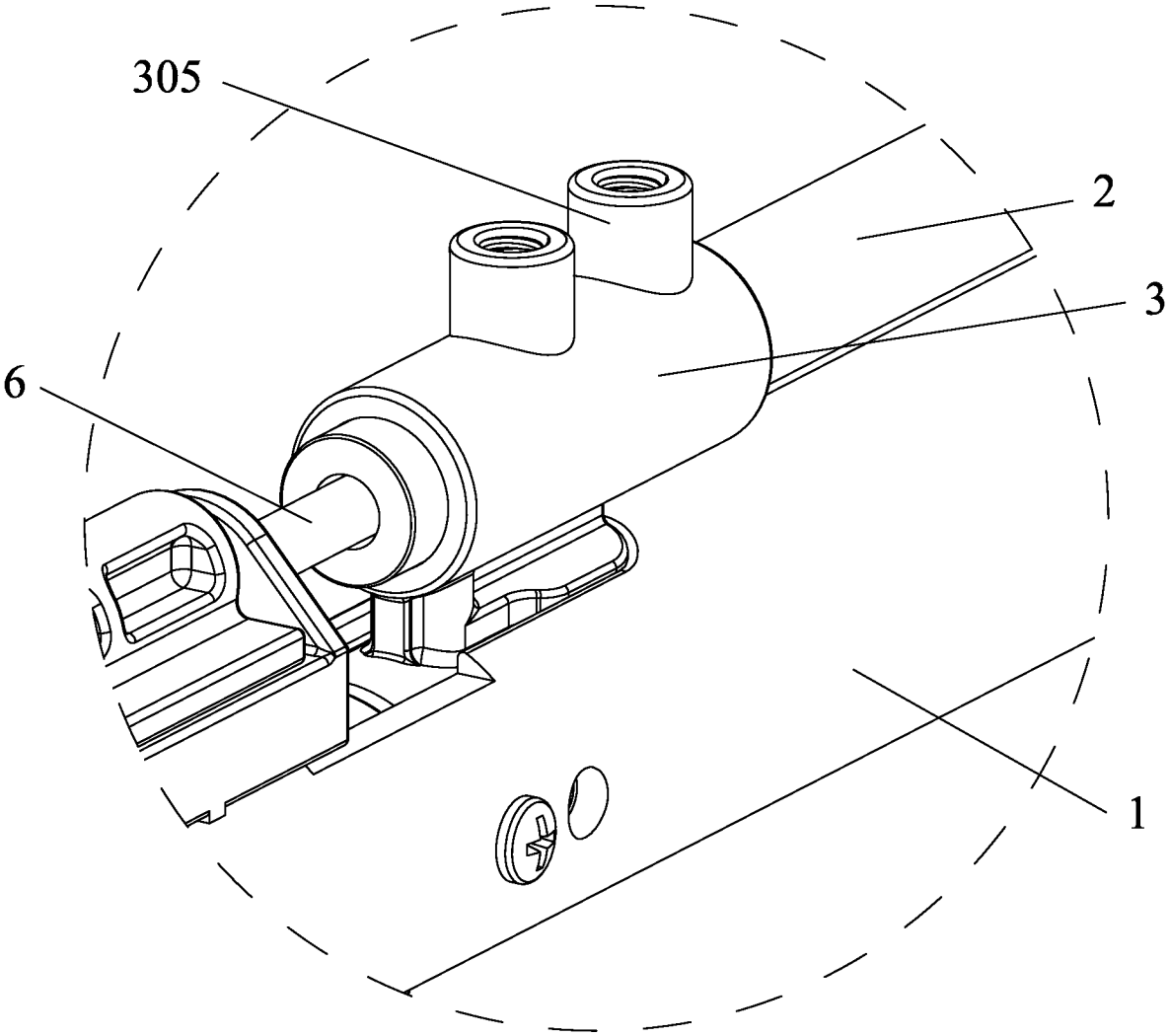
FIG. 2 is a local enlarged view of part A in FIG. 1.
Figure 3:
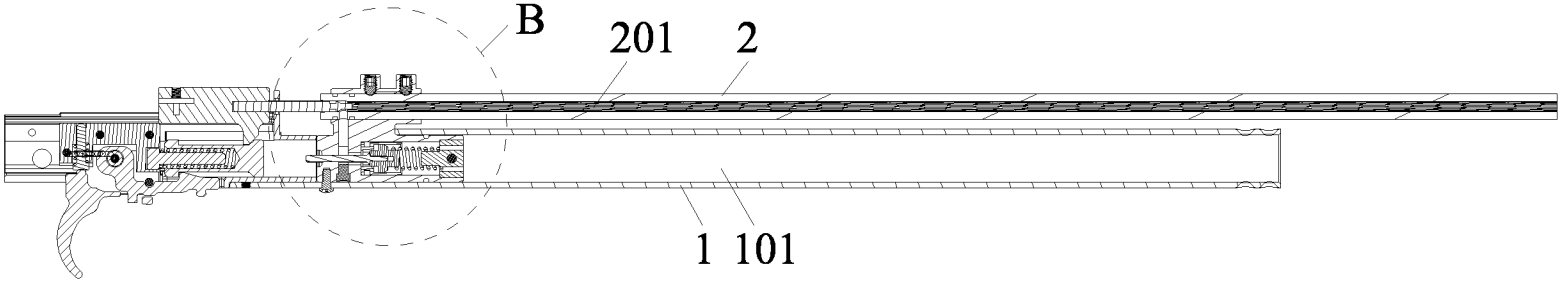
FIG. 3 is a sectional view of an air gun of the disclosure.
Figure 4:
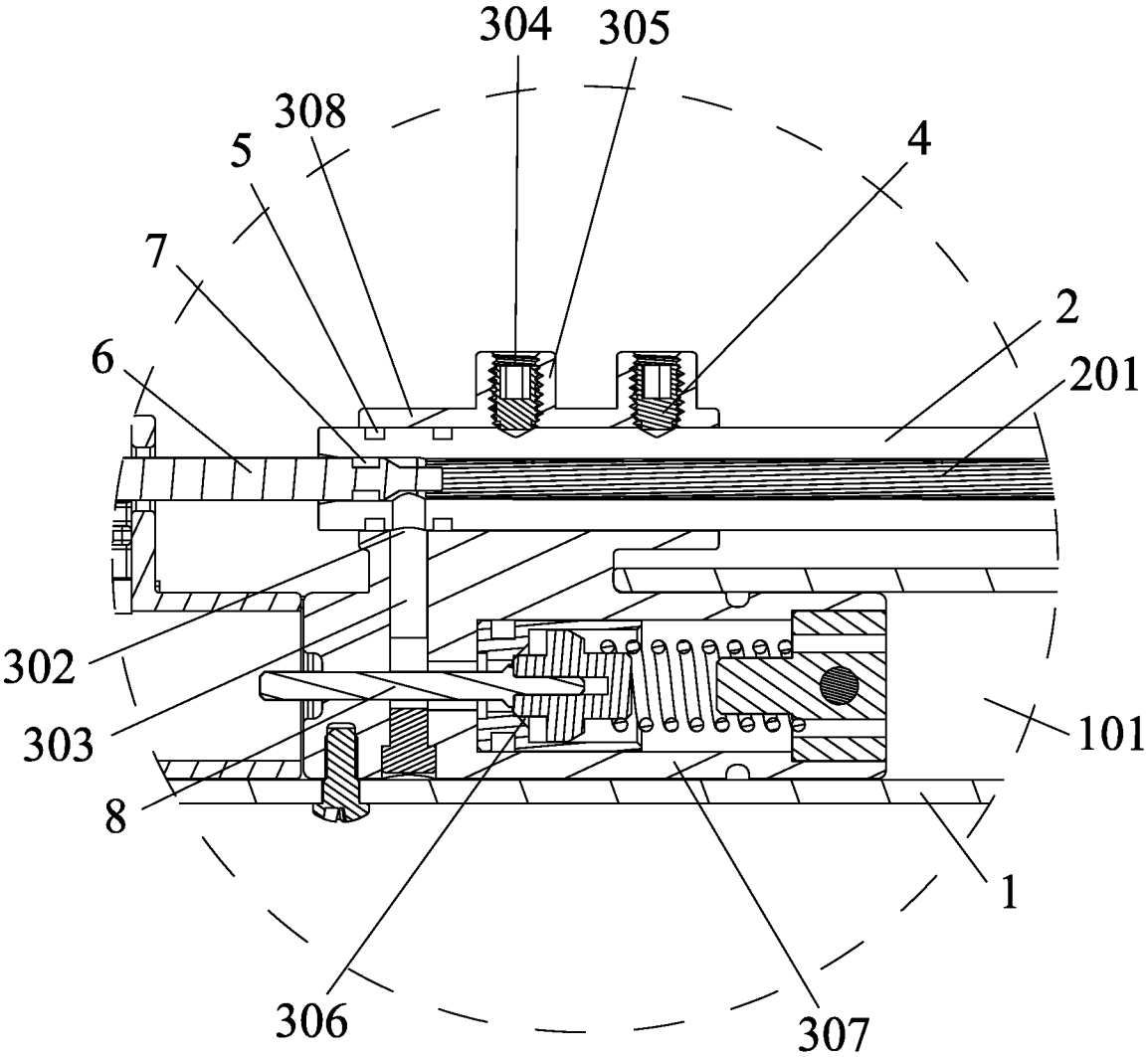
FIG. 4 is a local enlarged view of part B in FIG. 3.
Figure 5:
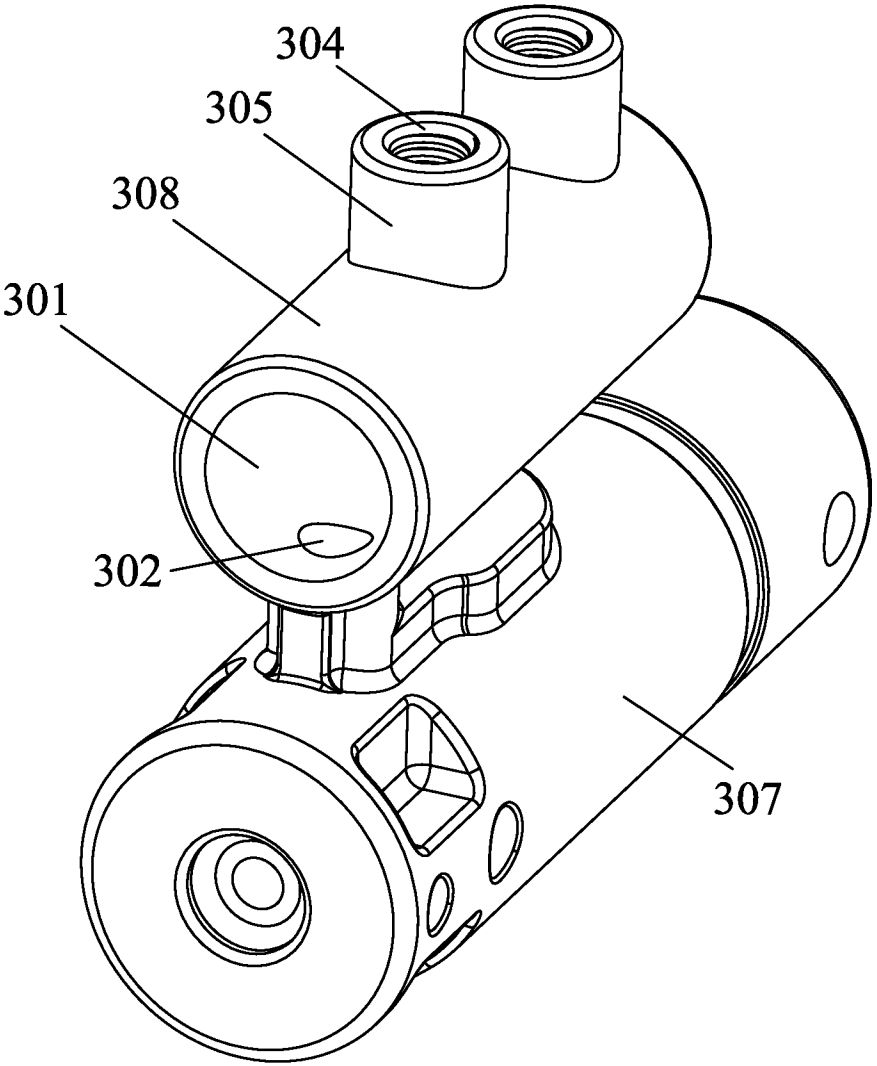
FIG. 5 is a stereograph of an air valve of the disclosure.
Figure 6:
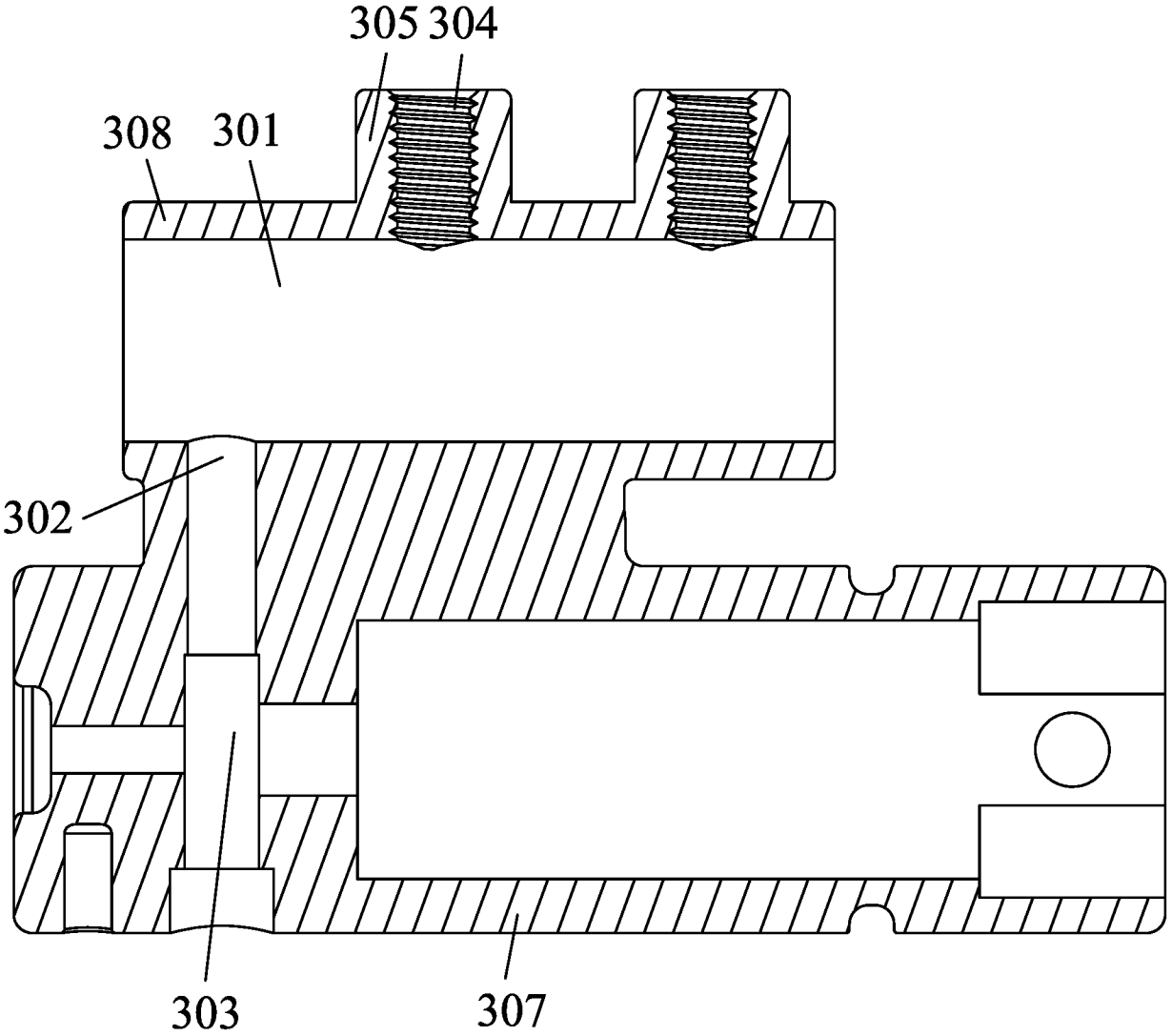
FIG. 6 is a sectional view of an air valve of the disclosure.
Figure 7:
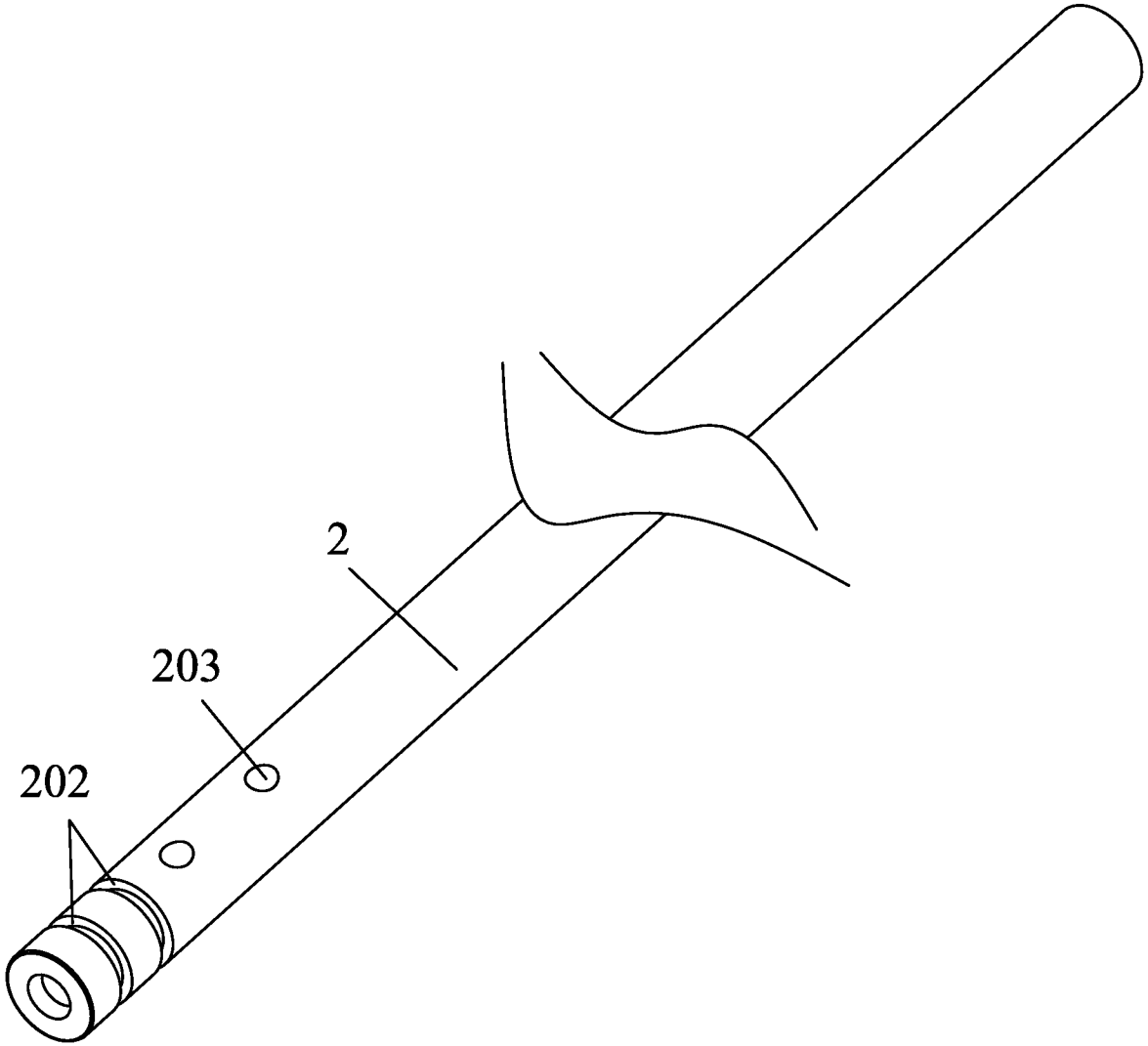
FIG. 7 is a stereograph of a cartridge of the disclosure.
Figure 8:
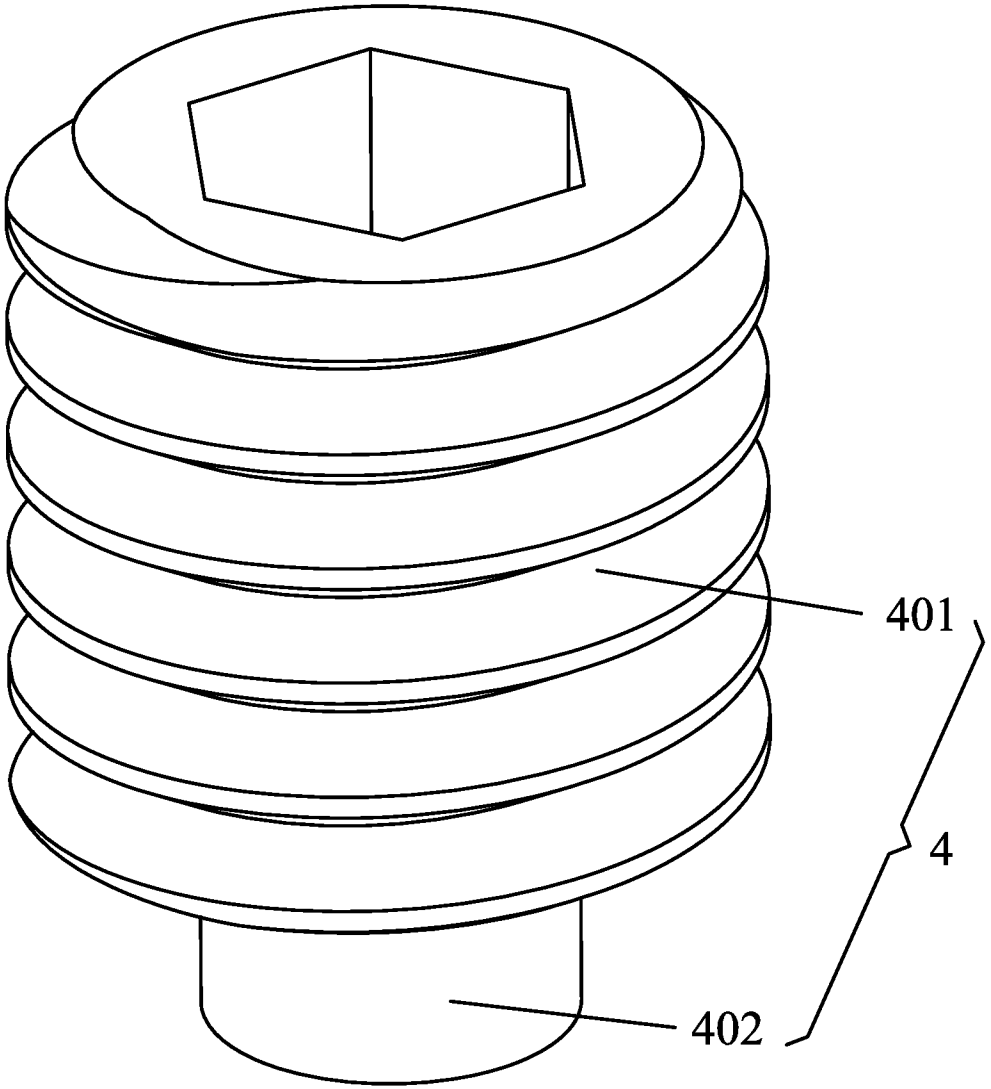
FIG. 8 is a stereograph of a stop piece of the disclosure.

As shown in FIGS. 1-8, the disclosure provides an air gun comprising a cylinder 1, a cartridge 2, an air valve 3, a stop piece 4. The air valve comprises an assembly channel 301, a communication port 302, and an air passage 303 connected to the assembly channel 301 through the communication port 302; the cartridge 2 is disposed in the assembly channel 301 and comprises an ejection channel 201 communicating with the air passage 303 through the communication port 302; the stop piece 4 is disposed on the air valve 3 to push the cartridge 2 towards the communication port, thereby locking the cartridge onto the air valve, and tightly fitting the cartridge and the air valve at least at an outer circumference of the communication port 302. The air gun of the disclosure is to solve the problem that the cartridge of a conventional air gun is connected to the air valve through interference fit, resulting in the air valve capable of being matched with only a unique cartridge of the same size and having a poor adaptability. The cartridge 2 of the disclosure is disposed in the assembly channel 301 of the air valve 3 and the cartridge 2 is locked on the air valve 3 by the stop piece 4. The cartridge 2 and the air valve 3 are tightly adhered to each other at least at the periphery of the communication port 302. The cartridge 2 and the air valve 3 are connected to each other through the stop piece 4 butting against the cartridge 2 to realize the connection between the cartridge 2 and the air valve 3, so that the assembly channel 301 can be adapted to the different sizes of the cartridge 2 (the precondition is that the outer diameter of the cartridge 2 is smaller than the inner diameter of the cartridge 2). In addition, the stop piece 4 locks the cartridge 2 on the air valve 3 so that the cartridge 2 tightly fits with the air valve 3 at least in the periphery of the communication port 302. Thus, the air passage 303 tightly communicates with the ejection channel 201 in the vicinity of the communication port 302, thus preventing the air leakage and improving the shooting effect.

Optionally, the air gun comprises a plurality of stop pieces 4, which are disposed at intervals in the axial direction of the air valve 3. Among them, the distance between the stop piece 4 closest to the communication port 302 and the communication port 302 is not more than twice the diameter of the stop piece 4. Due to the multiple number of the stop pieces 4, the connection between the cartridge 2 and the air valve 3 is stable. Since the distance between the stop piece 4 closest to the communication port 302 and the communication port 302 is not more than twice the diameter of the stop piece 4, the connection between the air passage 303 and the ejection channel 201 on the outer circumference of the communication port 302 is tight.

Optionally, the cartridge 2 is provided with two first seal rings 5; the two first seal rings 5 are disposed on opposite sides of the communication port 302, and against an outer wall of the cartridge 2 and an inner wall of the assembly channel 301, respectively. Thus, the communication port 302 is located in a sealed space formed by the two first seal rings 5, the cartridge 2, and the air valve 3, thus avoiding the air leakage and improving the shooting effect.

Optionally, the outer wall of the cartridge 2 comprises two seal grooves 202 for receiving the two first seal rings 5, respectively; and the two first seal rings 5 are embedded in corresponding seal grooves 202 through interference fit. Thus, the assembly of the first seal rings 5 with the cartridge 2 is stable thus avoiding the displacement of the first seal rings.

Optionally, the outer wall of the cartridge 2 comprises a locating groove 203, and the stop piece 4 extends into the locating groove 203. Thus, the stop piece is not easy to slip when butting against the cartridge 2, with a concentrated force.

Optionally, the depth of the locating groove accounts for a quarter or one third of the wall thickness of the cartridge 2, which prevents the stop piece 4 from sliding away from the locating groove 203 due to the shallow groove depth, and also prevents that the locating groove is too deep so as to affect the overall strength of the cartridge 2.

Optionally, one end of the stop piece 4 against the cartridge 2 is tapered, and the shape of the locating groove 203 is corresponding to the one end of the stop piece 4 against the cartridge 2. Thus, the stop piece 4 is stably fixed in the locating groove 203, avoiding the stop piece 4 from slipping away from the locating slot 203.

Optionally, the air valve 3 comprises a connection channel 304 for the stop piece 4 to extend into the assembly channel 301, and the stop piece 4 comprises a threaded part 401 in threaded connected to the connection channel 304 and a butting part 402 connected to the threaded part 401 to push against the cartridge 2. The design further stabilizes the connection of the air valve and the stop piece 4.

Optionally, the air valve 3 comprises a connecting column 305 extending radially outward from the outer wall of the air valve 3, and the connection channel 304 is formed in the connecting column 305. Thus, the connection channel 304 is long enough to stabilize the connection of the stop piece 4 in the connection channel 304.

Optionally, the connection channel 304 communicates with outside, and an axial length of the connection channel 304 is not less than an axial length of the stop piece 4. Thus, the stop piece 4 can be fully screwed into the connection channel 304 when being pushed against the cartridge 2, realizing a hidden assembly.

Optionally, the cartridge 2 comprises a first pin 6 capable of moving along the ejection channel 201 to open and close the communication port 302; a second seal ring 7 is disposed on the ejection channel 201, and butts against an outer wall of the first pin 6 and an inner wall of the ejection channel 201; and/or, the cylinder 1 comprises an inlet channel 101; the inlet channel 101 communicates with the air passage 303 through an intake port 306, and the air valve comprises a second pin 8 capable of moving along the air passage 303 to open and close the intake port 306.

When the second pin 8 opens the intake port 306 and the first pin 6 opens the communication port 302, the high-pressure air in the inlet channel 101 enters the ejection channel 201 via the air passage 303, causing the bullets in the ejection channel 201 to shoot out of the cartridge 2, achieving the firing of the bullets. When the second pin 8 closes the intake port 306, the second pin 8 blocks the high-pressure air from entering the air passage 303, thereby allowing the air gun in a ready state for firing.

Optionally, the air valve 3 is an integrally-formed structure and comprises a first connector 307 connected to the cylinder 1 and a second connector 308 connected to the cartridge 2; the first connector 307 is partially disposed in the inlet channel 101 and the air passage 303 is disposed in the first connector 307; the second connector 308 is disposed on the first connector 307 and the assembly channel 301 is disposed in the second connector 308; and the cartridge 2 is disposed through the assembly channel 301 of the second connector 308.

It will be obvious to those skilled in the art that changes and modifications may be made, and therefore, the aim in the appended claims is to cover all such changes and modifications.

What is claimed is:

1. An air gun, comprising:

a cylinder;

a cartridge;

an air valve; and a stop piece;

wherein:

the air valve comprises an assembly channel, a communication port, and an air passage connected to the assembly channel through the communication port;

the cartridge is disposed in the assembly channel and comprises an ejection channel communicating with the air passage through the communication port;

the stop piece is disposed on the air valve to push the cartridge towards the communication port, thereby locking the cartridge onto the air valve, and fitting the cartridge and the air valve at least at an outer circumference of the communication port; and the cartridge comprises a first pin movable along the ejection channel to open and close the communication port.

2. The air gun of claim 1, wherein the cartridge is provided with two first seal rings; the two first seal rings are disposed on opposite sides of the communication port, and against an outer wall of the cartridge and an inner wall of the assembly channel, respectively.

3. The air gun of claim 2, wherein the outer wall of the cartridge comprises two seal grooves for receiving the two first seal rings, respectively; and the two first seal rings are embedded in corresponding seal grooves through interference fit.

4. The air gun of claim 1, wherein an outer wall of the cartridge comprises a locating groove, and the stop piece extends into the locating groove.

5. The air gun of claim 4, wherein a depth of the locating groove accounts for a quarter or one third of a wall thickness of the cartridge; and/or, one end of the stop piece against the cartridge is tapered, and a shape of the locating groove is corresponding to the one end of the stop piece against the cartridge.

6. The air gun of claim 5, wherein the air valve comprises a connection channel for the stop piece to extend into the assembly channel, and the stop piece comprises a threaded part in threaded connected to the connection channel and a butting part connected to the threaded part to push against the cartridge.

7. The air gun of claim 6, wherein the air valve comprises a connecting column extending radially outward from an outer wall of the air valve, and the connection channel is formed in the connecting column.

8. The air gun of claim 6, wherein the connection channel communicates with outside, and an axial length of the connection channel is not less than an axial length of the stop piece.

9. The air gun of claim 4, wherein the air valve comprises a connection channel for the stop piece to extend into the assembly channel, and the stop piece comprises a threaded part in threaded connected to the connection channel and a butting part connected to the threaded part to push against the cartridge.

10. The air gun of claim 9, wherein the air valve comprises a connecting column extending radially outward from an outer wall of the air valve, and the connection channel is formed in the connecting column.

11. The air gun of claim 9, wherein the connection channel communicates with outside, and an axial length of the connection channel is not less than an axial length of the stop piece.

12. The air gun of claim 1, wherein the air valve comprises a connection channel for the stop piece to extend into the assembly channel, and the stop piece comprises a threaded part in threaded connected to the connection channel and a butting part connected to the threaded part to push against the cartridge.

13. The air gun of claim 12, wherein the air valve comprises a connecting column extending radially outward from an outer wall of the air valve, and the connection channel is formed in the connecting column.

14. The air gun of claim 12, wherein the connection channel communicates with outside, and an axial length of the connection channel is not less than an axial length of the stop piece.

15. The air gun of claim 1, wherein a second seal ring is disposed on the ejection channel, and butts against an outer wall of the first pin and an inner wall of the ejection channel; and the cylinder comprises an inlet channel; the inlet channel communicates with the air passage through an intake port, and the air valve comprises a second pin capable of moving along the air passage to open and close the intake port.

16. The air gun of claim 15, wherein the air valve is an integrally-formed structure and comprises a first connector connected to the cylinder and a second connector connected to the cartridge; the first connector is partially disposed in the inlet channel and the air passage is disposed in the first connector; the second connector is disposed on the first connector and the assembly channel is disposed in the second connector; and the cartridge is disposed through the assembly channel of the second connector.

* * * * *